United States Patent [19]

Ghazi

[11] Patent Number: 4,976,428

[45] Date of Patent: Dec. 11, 1990

[54] COMPACT WORKOUT APPARATUS

[76] Inventor: Mahmood M. Ghazi, 22482 Petra, Mission Viejo, Calif. 92692

[21] Appl. No.: 419,746

[22] Filed: Oct. 11, 1989

[51] Int. Cl.[5] ..... A63B 21/00

[52] U.S. Cl. ..... 272/134; 272/130; 272/900

[58] Field of Search ..... 272/117, 118, 130, 134, 272/144, 900, 62, 63

[56] References Cited

U.S. PATENT DOCUMENTS

| | | | |
|---|---|---|---|
| 332,989 | 12/1885 | Benedict . | |
| 960,213 | 5/1910 | Williams . | |
| 1,696,145 | 7/1924 | Wagoner . | |
| 2,219,219 | 10/1940 | Boger . | |
| 2,632,645 | 3/1953 | Barkschat . | |
| 3,042,978 | 7/1962 | Eames et al. . | |
| 4,063,726 | 12/1977 | Wilson | 272/130 |
| 4,300,761 | 11/1981 | Howard | 272/134 |
| 4,431,181 | 2/1984 | Baswell . | |
| 4,629,185 | 12/1986 | Vanhoutte et al. | 272/130 |
| 4,747,594 | 5/1988 | Houde | 272/900 X |
| 4,801,139 | 1/1989 | Amann | 272/130 |
| 4,809,973 | 3/1989 | Johns | 272/118 |
| 4,896,881 | 1/1990 | Djerdjerian | 272/900 |

FOREIGN PATENT DOCUMENTS

| | | | |
|---|---|---|---|
| 8601735 | 3/1986 | Int'l Pat. Institute | 272/130 |

*Primary Examiner*—Robert Bahr

*Attorney, Agent, or Firm*—Frank J. Uxa, Jr.

[57] ABSTRACT

A workout apparatus for use in a building having spaced apart structural members in a wall of the building is disclosed. This apparatus comprises a frame sized and adapted to be placed between two of the structural members. A force assembly, preferably hydraulically powered, is sized and adapted to fit within the frame when not in use. This assembly, when in use, acts to provide a force against which an adult human can exercise at least one body part.

21 Claims, 4 Drawing Sheets

COMPACT WORKOUT APPARATUS

BACKGROUND OF THE INVENTION

This invention relates to a compact workout apparatus suitable for use by an adult human. More particularly, this invention relates to such an apparatus which is adapted to be installed in the wall of a building.

Physical fitness is becoming increasingly important. More and more adult humans are working out to keep in shape. One important offshoot of this trend is a proliferation of workout devices that are to be used in one's home. Many of these devices are relatively compact in that they take up little space, e.g., in the bedroom or other room where the device is set up. However, with homes and apartments becoming smaller, even the relatively little space taken up by such workout devices is valuable and could be used for other things when the workout device is not in use. Also, having the workout device remain in view when not in use can be disadvantageous to the overall decor of the room in which the device is located.

Certain devices have been suggested which fold up and can be placed under one's bed when not in use. However, such devices may require substantial time and effort to unfold for a workout and to fold again for storage. Also, such foldable devices often fail to give a full body workout. That is, because of their compact structure, such foldable devices exercise only one part of the body. While this is better than nothing; a workout of more than one group of muscles is much more preferred.

Certain prior devices have been suggested which involve placing weights into a piece of furniture, e.g., a cabinet placed up against a wall. See, for example, Benedict U.S. Pat. No. 332,989; Boger U.S. Pat. No. 2,219,219; Barkschat U.S. Pat. No. 2,632,645; and Baswell U.S. Pat. No. 4,431,181. While the cabinet may hide the workout equipment, the presence of the cabinet in the room is a constant reminder of this equipment. Also, the cabinet itself does take up space.

The use of weights to provide a resistance force for a workout has disadvantages. The weights are bulky and, therefore, take up space. In addition, having a substantial amount of weight on the upper floors of a conventional home may be structurally dangerous. Also, weights are quite noisy in use so that, for example, one may not be able to use such weight-based devices in apartments or condominiums without disturbing one's neighbors.

Many of the prior compact workout devices were structurally unstable and, thus, could be easily upset with the possibility of injuring the person working out and/or damaging the surroundings in which the device is located.

SUMMARY OF THE INVENTION

A new workout apparatus has been discovered. This apparatus effectively resolves many, if not all, of the concerns and problems noted above with regard to prior devices. The apparatus is compact and is adapted to be totally removed from the interior space of the room when not in use. However, the apparatus is structurally stable and secure so that a complete workout can be conducted with little or no danger of upsetting or damaging the apparatus. Preferably, more than one part, or more than one group of muscles, of the body can be exercised. Also, the present apparatus preferably does not employ bulky, heavy and noisy weights.

In one embodiment, the present apparatus is adapted for use in a building with a wall having at least one external surface. This apparatus comprises frame means sized and adapted to be placed in the wall, preferably so that substantially no part of the frame means and the force means, described hereinafter, extends beyond an external surface of the wall. More preferably, the frame means is sized and adapted to be placed in the wall so that substantially the entire frame means is recessed relative to an external surface of the wall. The apparatus also includes force means, preferably secured to the frame means, structured to provide a force against which an adult human can exercise at least one body part or muscle group, preferably a plurality of body parts or muscle groups. This force means is sized and adapted to fit substantially entirely within the frame means when the force means is stored. In this manner, when the present workout apparatus is not in use, it can be stored in the wall in the frame means completely out of the interior space of the room, e.g., living space, of the building defined in part by the external surface of the wall in which the frame means is located. Thus, the entire room is available for other uses when the apparatus is not in use. Also, a door, curtain or the like covering can be provided so as to remove the present workout apparatus from sight when not in use.

The frame means is sized to be placed in a wall of a building. A particularly useful embodiment provides for the frame means to have a depth of less than about 12 inches, and more preferably less than about 6 inches. An especially useful frame means depth is about 4 inches. Thus, the frame means does not define another room, e.g., closet, in the building or house. Instead, the frame means defines a space quite specifically sized to hold the force means and other components, if any, of the present apparatus, and little or nothing else.

The frame means is preferably placed in the wall between two structural members, e.g., conventional wooden 2 inch by 4 inch beams, located in the wall. As used herein, the term "structural member" refers to an element which, together with other structural members, provides structural support and/or stability to the wall, and preferably to the building, in which the present apparatus is located.

The present apparatus preferably further comprises fastening means, e.g., a plurality of nails, screws, bolts or the like, acting to fasten the frame means in place in the wall, preferably between two adjacent structural members and more preferably to fasten the frame means to one, and especially to both, of such adjacent structural members. By positively fastening the housing means in place, the stability of the overall workout apparatus is greatly enhanced. None of the prior portable or compact workout devices, e.g., described above, were fastened to the structure of the building in which they were used. This increased stability allows one to engage in a high intensity workout without concern for damaging or upsetting the apparatus.

In a particularly useful embodiment, the force means is hydraulicly powered. More preferably, the force means includes no moveable weights, which, as noted above, are bulky and noisy in use, and may even be detrimental to the structure of the building. The use of a hydraulicly powered force means is particularly advantageous in the present invention since such a system is easily adapted to be compact, and thus to fit into the relatively confined space of the present frame means. Also, such a hydraulic system is very quiet, e.g., relative to the use of moveable weights. Thus, one can get a good workout without disturbing the people in the adjacent house, apartment or condominium. Moreover, the hydraulic system is substantially maintenance free.

The hydraulically powered force means preferably includes a hydraulic axial piston pump, e.g., of conventional design. This pump produces the force against which the adult human exercises his/her body. In the present system, this pump is preferably associated with a shaft which rotates in either direction, i.e., clockwise or counterclockwise. In a particularly useful embodiment, the pump can be controlled to provide a resistance force when the shaft is rotating in both directions or in only one direction. This feature provides a great deal of flexibility to the present apparatus, that is, allows the apparatus to be used to exercise various parts or muscle groups of the body. For example, when exercising the arms and upper torso, it may be desired to have a resistance force when one extends his/her arms, and when one pulls his/her arms back toward the body. In this situation, the pump is set to provide resistance force as the shaft rotates in both directions. On the other hand, if the body part being exercised requires a resistance force in only one part of the exercise, e.g., during the extending part of exercise, then the pump is controlled to provide a resistance force when the shaft is rotated in one direction but not in the other direction.

In addition, the hydraulic pump is preferably controllable to adjust the amount of resistance force applied. This feature allows the apparatus to be used to exercise different parts of a person's body and also to be used by different people with different exercise needs.

In short, the present preferred hydraulicly powered force means provides all the exercise flexibility of a weight-based system without any of the disadvantages of a weight-based system.

In any event, whether a weight based force means or a hydraulicly powered force means is used, the force means further includes a force transfer system acting to transfer the resistance force from the weights or hydraulic pump to the body of the person using the workout apparatus. A particularly useful force transfer system includes a belt, chain or the like and one or more pulleys or the like. When the force means is hydraulicly powered, the force transfer system preferably translates between linear motion and rotational motion.

The present frame means preferably further comprises a substantially stationary track on which at least a portion of said force means is moveable. In one embodiment, a linearly moveable element, which forms part of the force transfer system, is moveable, in particular slidable, on the stationary track. This feature provides for effective guidance or control of the movement of the moveable element.

A bench is sized and adapted to support the weight of an adult human when the bench is extended is preferably included in the present apparatus. When not in use, i.e., when not extended, the bench fits within the frame means. Preferably the bench is slidable on the substantially stationary track between the extended (use) configuration and the retracted (non-use) configuration. In a particularly useful embodiment, the track includes a series of through holes along at least a portion of its length, and the bench includes an attachment component with a through hole. A shaft, preferably a L-shaped element, is provided which is sized and adapted to fit through any one of the through holes in the track and the through hole in the attachment component at the same time. This feature assures that the bench remains in place in the housing means when not in use. In addition, this feature allows the bench to be used at any one of a plurality of angles, relative to the horizontal, as desired in exercising various parts of the body.

The substantially stationary track is preferably hollow so that at least a portion of the force transfer system, e.g., the belt, chain or the like, can be located therein.

The linearly moveable element, described above, is preferably directly linked to the belt, chain or the like of the force transfer means, and is associated with one or more components which the human adult grips or otherwise contacts in exercising his/her body. For example, the linearly moveable element may be secured to an outwardly extendable arm which includes a hole through which a shaft can be placed. This shaft, which is removable from the hole in the extendable arm for storage, can be gripped by a human desiring to exercise his/her upper torso and arms. In addition, an elongated line can be attached to the extendable arm, and itself extended to and be secured to one or more moveable assemblies, e.g., located at the end of the bench. The moveable assembly or assemblies are positioned to allow a human to come in contact with such assembly or assemblies to exercise his/her legs.

These and other aspects and advantages of the present invention are set forth in the following detailed description and claims, particularly when considered in conjunction with the accompanying drawings in which like parts bear like reference numerals.

DETAILED DESCRIPTION OF THE DRAWINGS

Figure 1:
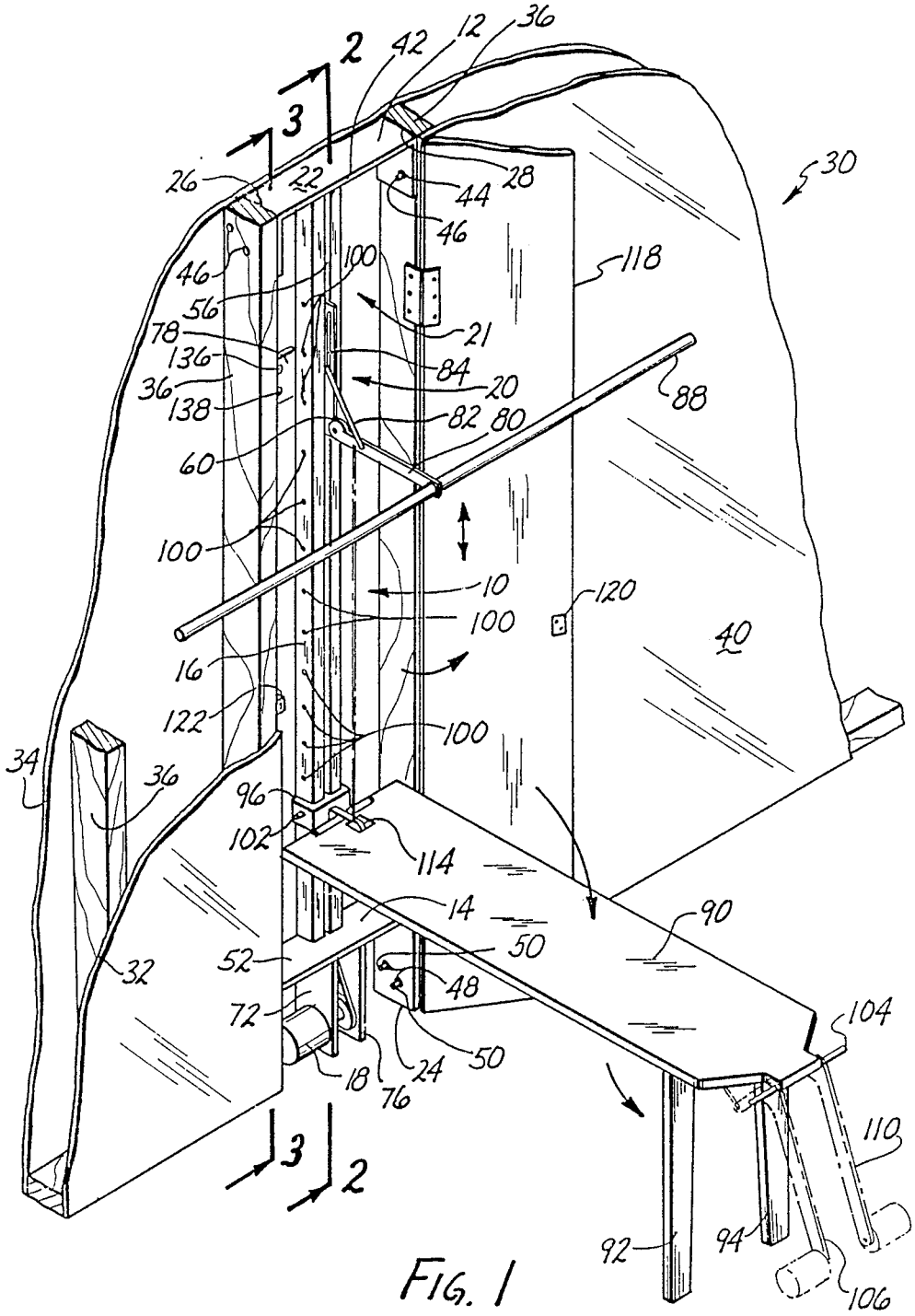
FIG. 1 is a front side perspective view, partly in cross-section, showing an embodiment of the present workout apparatus in place in a wall and extended ready for use.

Referring now to the drawings, a workout apparatus, shown generally at 10, includes an upper frame element 12, a lower frame element 14, a stationary track 16, a hydraulic pump 18 and a force transfer system, shown generally at 20.

Upper frame element 12, lower frame element 14 and stationary track 16, together hereinafter referred to as the basic frame and shown generally at 21, are secured, e.g., welded, together to form the basic frame of apparatus 10. The dimensions of this basic frame 21 include a height (from the top surface 22 of upper frame element 12 to the bottom 24 of lower frame element 14) of 7 feet; a width (the shortest distance between the opposing outer edges 26 and 28 of upper frame element 12) of 15 inches; and a depth (the length of either of the opposing outer edges 26 or 28) of 4 inches. This basic frame 21 is sized to fit into a wall, shown generally at 30, which includes forward wall element 32, a rearward wall element 34 and a series of vertically extending, horizontally spaced apart structural members 36 located therebetween and secured thereto.

Forward wall element 32 includes an exterior surface 40 which partially defines a room, e.g., a bedroom, in the house in which wall 30 is located. Forward wall element 32 may be made of plaster board or the like material, and exterior surface 40 may be painted, covered with wall paper or otherwise suitably decorated. The structural members 36 are conventional 2 inch by 4 inch wooden members.

The basic frame 21, which is preferably made of metal, of apparatus 10 is placed in the wall 30 so as to be recessed relative to exterior surface 40. If desired, the basic frame 21 can be positioned so that the forward most surface 42 of upper frame element 12 is substantially flush with exterior surface 40. Upper frame element 12 includes four holes 44 (only one shown in FIG. 1) through which bolts 46 can be passed to secure upper frame element 12 to the adjacent structural members 36. Similarly, lower frame element 14 includes four holes 48 (only two shown in FIG. 1), two on either side thereof, through which bolts 50 can be passed to secure lower frame element 14 to the adjacent structural members 36. It may be desirable to secure track 16 to one or both of the structural members 36. In any event, the basic frame 21 is secured to the adjacent structural member 36. This securement in effect locks apparatus 10 in place in wall 30 so that a vigorous, high intensity workout can be accomplished without damaging the apparatus 10 and without dislodging it from wall 30.

Figure 2:
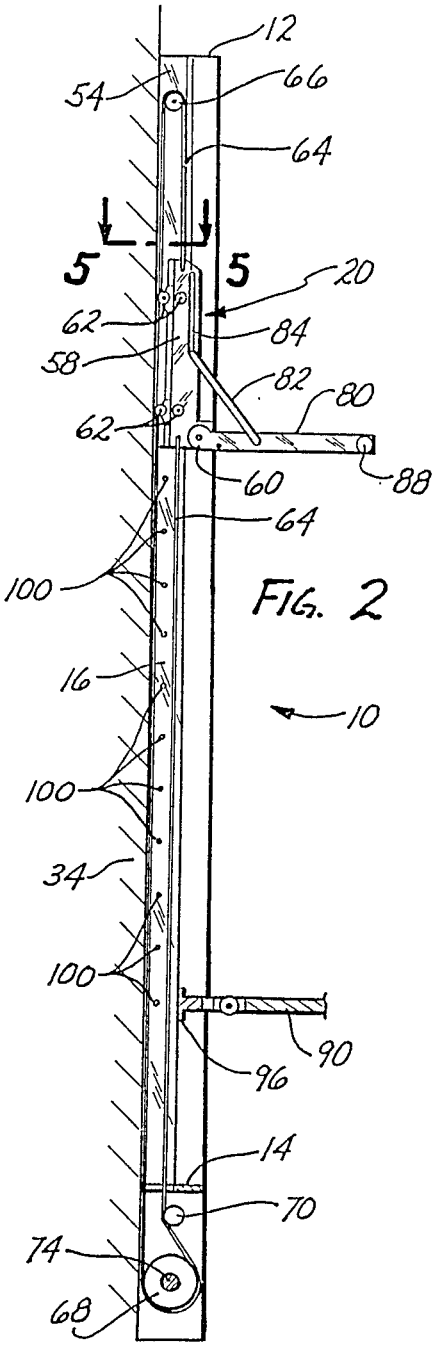
FIG. 2 is a cross-sectional view of the embodiment shown in FIG. 1 taken generally along line 2—2 in FIG. 1.
Figures 4, 5:
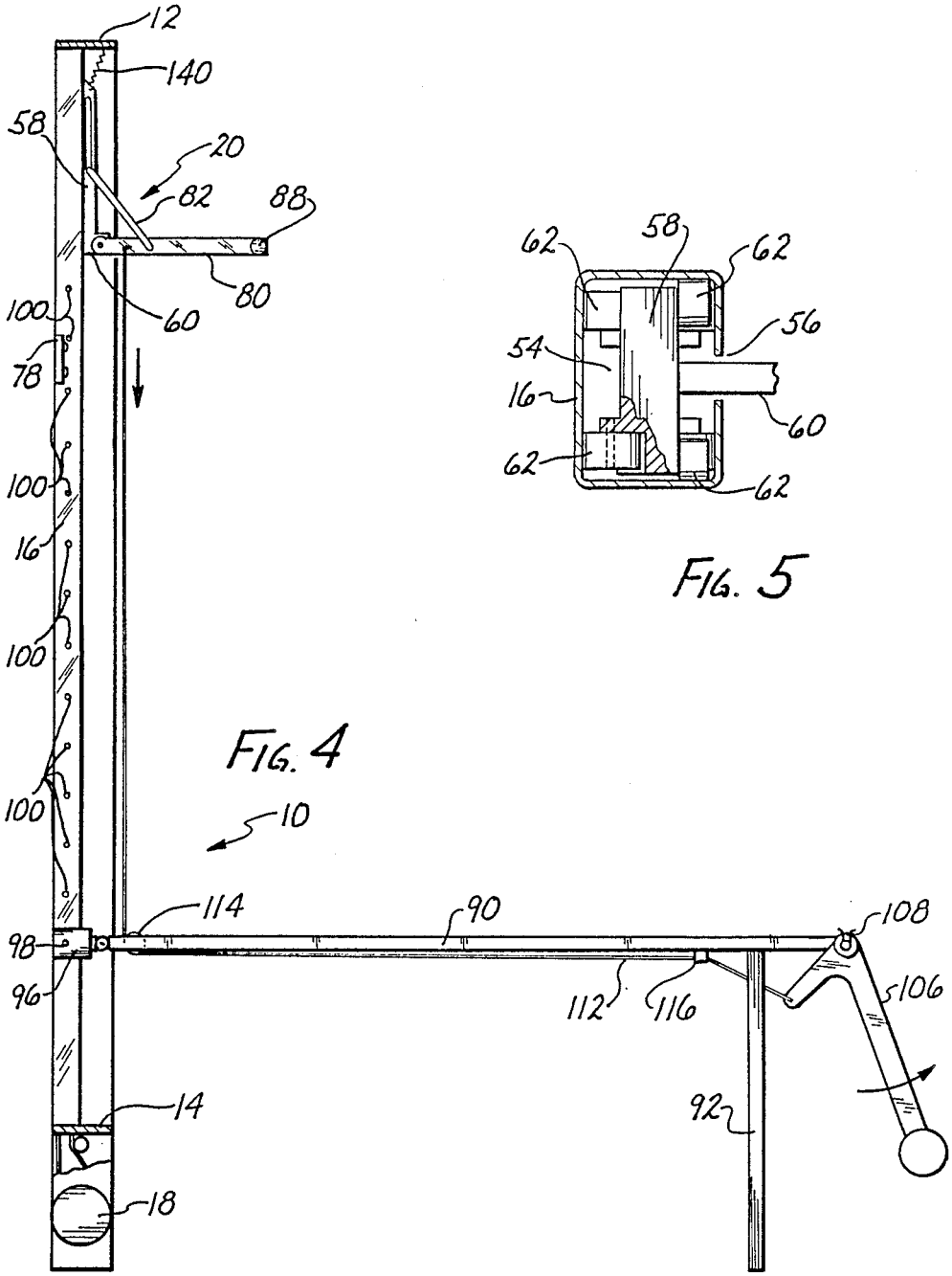
FIG. 4 is a plan view, partly cut away, of the embodiment shown in FIG. 1 in the use configuration taken generally along line 3—3 of FIG. 1.
FIG. 5 is an elevational view, partly in cross section, taken generally along line 5—5 of FIG. 2.

Stationary track 16 extends from upper frame element 12 to and through the top member 52 of lower frame element 14, and defines a longitudinally extending hollow space 54, as best seen in FIGS. 2 and 5. Stationary track 16 has a longitudinally extending forward facing opening 56. A slide element 58 is located in hollow space 54 and includes a slide extension 60 which extends forwardly out of opening 56. A series of rollers 62, e.g., teflon coated wheels, rotatably affixed to slide element 58 also contact stationary track 16 and act to provide smooth, quiet and stable movement of slide element 58 in hollow space 54.

One end of a force transfer chain 64 is secured, e.g., tied, to the upper portion of slide element 58. The other end of chain 64 is secured to the lower portion of slide element 58. With particular reference to FIG. 2, the path of chain 64 from its securement to the upper portion of slide element 58 is such that chain 64 passes around chain pulley 66, which is secured to the stationary track 16. Chain 64 then passes down the entire length of stationary track 16 and around a power pulley 68, then up to contact a guide pulley 70, which is mounted to lower frame element 14, and finally up stationary track 16 to its securement to the lower portion of slide element 58. Chain 64 is an important component in converting between the rotational movement of hydraulic pump 18 and the linear movement of slide element 58.

Hydraulic pump 18 is a hydraulic axial piston pump of conventional design and is mounted to right depending leg 72 of lower frame element 14. Pump shaft 74 is also rotatably mounted to left depending leg 76 of lower frame element 14, and carries power pulley 68. The combination of shaft 74, power pulley 68 and chain 64 transfer the resistance force produced by pump 18 to slide element 58. Pump control panel 78 is secured to stationary track 16 and is used to control the action of pump 18. The connections between pump control panel 78 and pump 18 pass through hollow space 54 of stationary track 16. These connections are conventional and, in order to more clearly illustrate other components of apparatus 10, are not shown in the drawings. The operation of pump 18 and pump control panel 78 will be discussed hereinafter.

Figure 3:
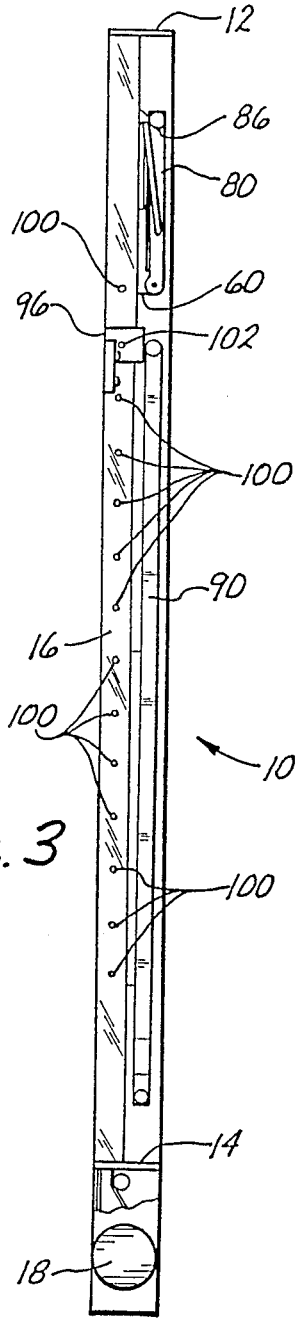
FIG. 3 is a plan view, partly cut away, of the embodiment shown in FIG. 1 in the stored configuration taken generally along line 3—3 of FIG. 1.

An extension arm 80 is hingedly secured to slide element 58. When apparatus 10 is in its use configuration, extension arm 80 is extended an shown in FIG. 2. In this configuration, extension arm 80 is sufficiently stable and strong to receive forces applied by pump 18 and/or by an adult human using apparatus 10, without collapsing or otherwise being damaged. When it is desired to place extension arm 80 in its stored configuration, extension arm 80 is urged toward stationary track 16 and, at the same time, support member 82 is moved up elongated hole 84 in slide element 58. FIG. 3 shows extension arm 80 in its stored configuration in which it does not extend beyond the forward most surface 42 of upper frame element 12.

The far end of extension arm 80 includes a threaded hole 86 through which an elongated rod 88 can be passed and threadably secured in place. This, rod 88 includes threads on its central portion which matingly engage the threads in threaded hole 86. When apparatus 10 is in use, rod 88 is secured through threaded hole 86 to extension arm 80. Rod 88 is useful in exercising the arms and upper torso. In the stored configuration, rod 88 is removed from extension arm 80 and stored within the basic frame 21 of apparatus 10.

A bench 90 capable of supporting the weight of an adult human is provided with legs 92 and 94 which are pivotably secured to bench 90. The rearward end of bench 90 is rotatably secured to bracket 96, which surrounds the forward part of stationary track 16. Bracket 96 includes a hole 98 which is positioned to be alignable with any one of the holes 100 in stationary track 16. A pin 102 is provided which can be placed in both aligned holes 98 and 100. In this manner, bench 90 is held stationary in place relative to stationary track 16. In addition, since there are a plurality of holes 100 in stationary track 16, bench 90 can be held stationary at a number of intermediate positions, other than substantially flat as shown in the FIGS. When it is desired to store bench 90, legs 92 and 94 are folded up, and bench 90 is moved up stationary track 16 until hole 98 is aligned with the uppermost hole 100 and pin 102 is inserted into these aligned holes. Bench 90, in the stored configuration, depends from bracket 98 as shown in FIG. 3. In the stored configuration, bench 90 does not extend beyond the forward most surface 42 of upper frame element 12.

The forward end of bench 90 includes a laterally extending shaft 104 which extends outwardly from both sides of bench 90. Right lever arm 106 includes a hole adapted to receive the right side extension of shaft 104. A conventional fast on connector clip, shown schematically at 108 is used to secure right lever arm 106 to shaft 104. In a similar manner, left lever arm 110 may be mounted on and secured to the opposing portion of shaft 104. Both lever arms 106 and 110 may also be secured, e.g., tied, through the use of fast on connectors or otherwise, to an elongated flexible cord 112, e.g., made of polyamide (nylon) or the like polymeric materials. Cord 112 passes under bench 90, around a pulley guide 114 located at the rear of bench 90, and upward where it is secured to extension arm 80. A guide 116 is secured to the underside of bench 90 and acts to receive and guide the movement of the cord 112.

The lever arms 106 and 110, when in the use configuration, i.e., being secured to shaft 104 and cord 112 as shown in FIG. 4, are linked to pump 18 through cord 112, extension arm 80, slide element 58 and force transfer chain 64, and are particularly useful in exercising one's legs. In the non-use configuration, i.e., being removed from shaft 104 and detached from cord 112, lever arms 106 and 110 are stored within the basic frame 21 of apparatus 10 so that no part of lever arms 106 and 110 extend beyond the forward most edge 42 of upper frame element 12.

Forward wall element 32 is cut out around apparatus 10, e.g., to allow for the installation of apparatus 10. A door 118 is provided which, when closed, covers this cut out. Door 118, which is hinged to one of the structural members 36, is of such a thickness that when closed it is flush with the exterior surface 40. The exterior surface of door 118 (not shown) is decorated, e.g., painted, wall-papered or the like, similarly to exterior surface 40. A conventional magnetic latch, shown schematically as latch components 120 and 122, is provided so that door 118 remains closed, when desired. With door 118 in place, when apparatus 10 is not in use and in the stored configuration, apparatus 10 is completely out of sight and completely removed from the room partially defined by exterior wall 40. With door 118 closed, there is little or no visible indication that workout apparatus 10 is present.

Figure 6:
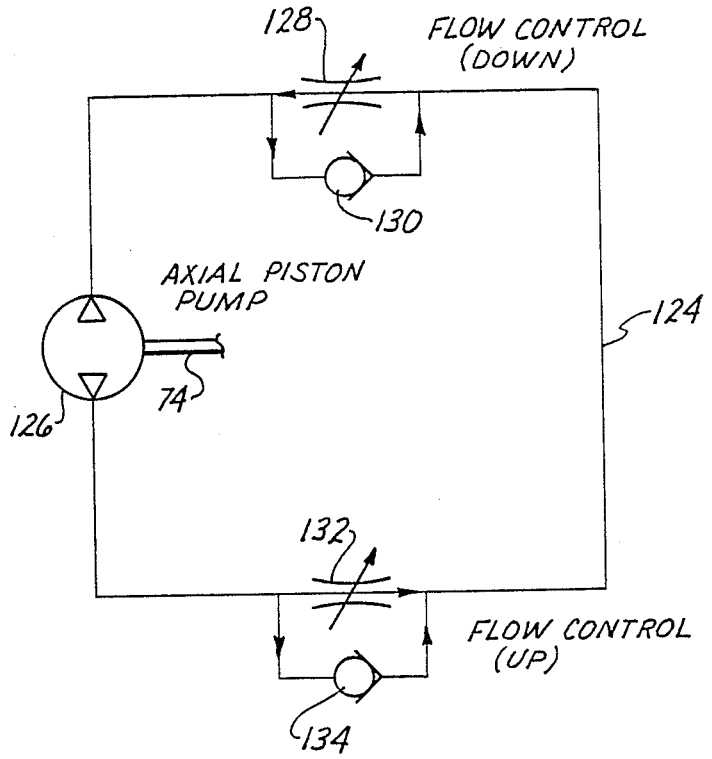
FIG. 6 is a schematic view of the operation of the hydraulic pump shown in FIG. 1.

FIG. 6 provides a schematic view of the operation of pump 18. Hydraulic fluid is adapted to flow in flow loop 124 in one direction, clockwise or counterclockwise, at a time. This fluid enters the pump mechanism 126 and provides resistance to the rotation of shaft 74 in the corresponding direction. Flow loop 124 includes a first flow restrictor 128 and a first by-pass 130, and an opposing second flow restrictor .132 and a second by-pass 134. First flow restrictor 128 controls the amount of fluid passing to pump mechanism 126, and therefore the amount of resistance to the rotation of shaft 74, when slide element 58 is moved downwardly. Similarly, second flow-restrictor 132 controls the amount of fluid passing to pump mechanism 126, and therefore the amount of resistance to the rotation of shaft 74, when slide element 58 is moved upwardly. First control dial 136 on control panel 78 can be manually set and adjusted to control the first flow restrictor 128. Second control dial 138 can be independently manually set and adjusted to control the second flow restrictor 132. In this manner, the amount of resistance force in both directions produced by pump 18 can be adjusted, as desired to suit the various needs of the person using apparatus 10. Of course, the amount of resistance can be set at zero. Control panel 78 preferably includes a visual display to indicate to the user of apparatus 10 how much resistance force is to be applied in both directions.

A spring 140 secured to upper frame element 12 and slide element 58 is provided and acts to urge slide element 58 upward on track 16. Spring 140 is particularly useful when lever arms 106 and 110 are used for leg exercises. Spring 140 draws slide element 58 upwardly so that lever arms 106 and 110 are retracted to their initial positions, e.g., for the leg curl exercise.

Apparatus 10 can easily and quickly be converted from its stored configuration in wall 30 into its use configuration, e.g., as shown in FIG. 4. Pump 18 can be controlled to provide the desired amount, if any, of resistance force in each direction. Rod 88 can be gripped, pulled and pushed to exercise the arms and upper torso. Lever arms 106 and 110 can be rotated using the legs to exercise the legs. When rod 88 is being gripped, it is preferred to detach cord 112 from lever arms 106 and 110.

After a full range, high intensity workout, apparatus 10 can be easily and quickly converted into its stored configuration. At this point, door 118 is closed and latched so that apparatus 10 is completely out of sight.

While this invention has been described with respect to various specific examples and embodiments, it is to be understood that the invention is not limited thereto and that it can be variously practiced within the scope of the following claims.

What is claimed is:

1. A workout apparatus for use in a building comprising:

a wall located in a building and including an external surface which partially defines a room in the building;

frame means at least partially in said wall, said frame means having a depth of less than about 12 inches, said external surface positioned to extend outwardly from said frame means; and force means structured to provide a force against which an adult human can exercise at least one body part, said force means being sized and adapted to fit substantially entirely within said frame means when said force means is stored.

2. The apparatus of claim 1 wherein said frame means is in said wall so that substantially no part of said frame means and said force means extends beyond said external surface of said wall when said force means is stored.

3. The apparatus of claim 1 wherein said frame means is in said wall so that substantially the entire frame means is recessed relative to said external surface of said wall.

4. The apparatus of claim 1 wherein said wall further includes two structural members and said apparatus further comprises fastening means acting to fasten said frame means in place within said wall between said two structural members.

5. The apparatus of claim 1 wherein said wall further includes at least one structural member and said apparatus further comprises fastening means acting to fasten said frame means within said wall to said at least one structural member.

6. The apparatus of claim 1 wherein said force means is useful to provide a force against which an adult human can exercise a plurality of body parts.

7. The apparatus of claim 1 wherein said force means is useful to provide a force against which an adult human can exercise his/her arms, upper torso and legs.

8. The apparatus of claim 1 wherein said force means is powered by a hydraulic pump.

9. The apparatus of claim 8 wherein each of the amount of the force provided by said force means and the direction of the force provided by said force means is independently adjustable.

10. The apparatus of claim 1 which further comprises a bench sized and adapted to support the weight of an adult human and to be stored substantially entirely within said frame means.

11. The apparatus of claim 1 where said frame means includes a substantially stationary track on which at least a portion of said force means is moveable.

12. The apparatus of claim 1 which further comprises a bench sized and adapted to support the weight of an adult human and to be stored substantially entirely within said frame means, said bench being moveable on said substantially stationary track between a fully extended position and a stored position.

13. The apparatus of claim 12 said bench and said substantially stationary track are each configured so that said bench may be located and secured at at least one intermediate position.

14. The apparatus of claim 1 which further comprises a cover means acting to cover said force means when said force means is fitted into said frame means.

15. The apparatus of claim 1 wherein said frame means has a depth of less than about 6 inches.

16. The apparatus of claim 1 wherein said frame means has a depth of about 4 inches.

17. A workout apparatus comprising:

frame means located at least partially in a wall of a building, said frame means having a depth of less than about 6 inches; and force means structured to provide a force against which an adult human can exercise at least one body part, said force means being sized and adapted to fit substantially entirely within said frame means when said force means is stored.

18. The apparatus of claim 17 which further comprises fastening means acting to fasten said frame means within the wall.

19. The apparatus of claim 17 wherein said force means is powered by a hydraulic pump.

20. A workout apparatus comprising:

a wall located in said building and including an external surface;

frame means in said wall, and including a substantially stationary track, said external surface positioned to extend outwardly from said frame means; and force means structured to provide a force against which an adult human can exercise at least one body part, said force means being sized and adapted to fit substantially within said frame means when said force means is stored, at least a portion of said force means being moveable on said substantially stationary track.

21. The apparatus of claim 20 wherein said force means is powered by a hydraulic pump.

* * * * *

UNITED STATES PATENT AND TRADEMARK OFFICE

CERTIFICATE OF CORRECTION

PATENT NO. : 4,976,428

DATED : December 11, 1990

INVENTOR(S) : Mahmood M. Ghazi

It is certified that error appears in the above-identified patent and that said Letters Patent is hereby corrected as shown below:

Column 9, line 4; delete "1" and insert in place thereof --11--

Signed and Sealed this

Twenty-eighth Day of April, 1992

*Attest:*

HARRY F. MANBECK, JR.

*Attesting Officer*

*Commissioner of Patents and Trademarks*